United States Patent [19]

Mitter

[11] 4,173,928

[45] Nov. 13, 1979

[54] SCREEN PRINTING MACHINE

[76] Inventor: Mathias Mitter, Falkenstrasse 57, 4815 Schloss Holte, Fed. Rep. of Germany

[21] Appl. No.: 835,793

[22] Filed: Sep. 22, 1977

[30] Foreign Application Priority Data

Sep. 25, 1976 [DE] Fed. Rep. of Germany ..... 2643226

[51] Int. Cl.[2] ..... B05C 17/06

[52] U.S. Cl. ..... 101/126; 68/200

[58] Field of Search ..... 101/120, 122, 123, 124, 101/126, 118; 198/689; 118/848, 50; 8/149.1; 68/200

[56] References Cited

U.S. PATENT DOCUMENTS

| | | | |
|---|---|---|---|
| 3,137,230 | 6/1964 | Ichinose | 101/123 X |
| 3,313,232 | 4/1967 | van der Winder | 101/118 |
| 3,618,838 | 11/1971 | Schieren | 198/689 X |
| 3,628,654 | 12/1971 | Haracz | 198/689 |
| 3,715,027 | 2/1973 | Fujimoto | 101/122 X |
| 3,818,391 | 6/1974 | Jordon et al. | 101/122 X |
| 3,902,414 | 9/1975 | Zimmer et al. | 101/126 X |
| 3,941,053 | 3/1976 | Black et al. | 101/124 |
| 3,949,864 | 4/1976 | Montsant | 101/126 X |
| 3,969,999 | 7/1976 | Zimmer | 101/123 X |

FOREIGN PATENT DOCUMENTS

| | | | |
|---|---|---|---|
| 1252167 | 10/1967 | Fed. Rep. of Germany | 101/126 |
| 2544808 | 4/1976 | Fed. Rep. of Germany | 101/123 |
| 451548 | 9/1949 | Italy | 101/126 |
| 878094 | 9/1961 | United Kingdom | 101/123 |

*Primary Examiner*—E. H. Eickholt

*Attorney, Agent, or Firm*—Michael J. Striker

[57] ABSTRACT

A printing station includes a printing screen and an endless gas-permeable carrier band of screen material is provided which has a workpiece supporting run extending beneath the printing screen and on which a sheet-material workpiece to be printed is transported. A suction device is arranged below the supporting run for drawing printing ink into the workpiece on the same.

16 Claims, 8 Drawing Figures

Fig.1
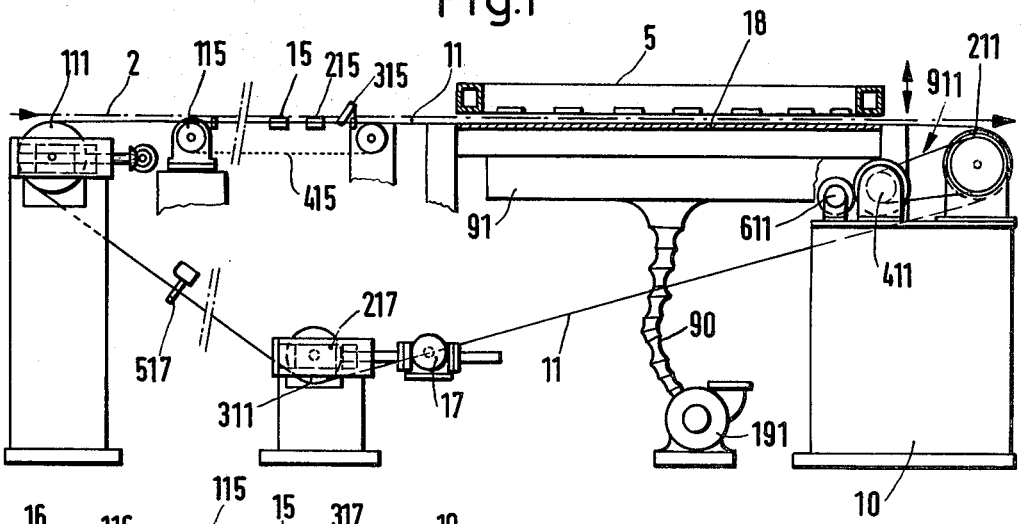
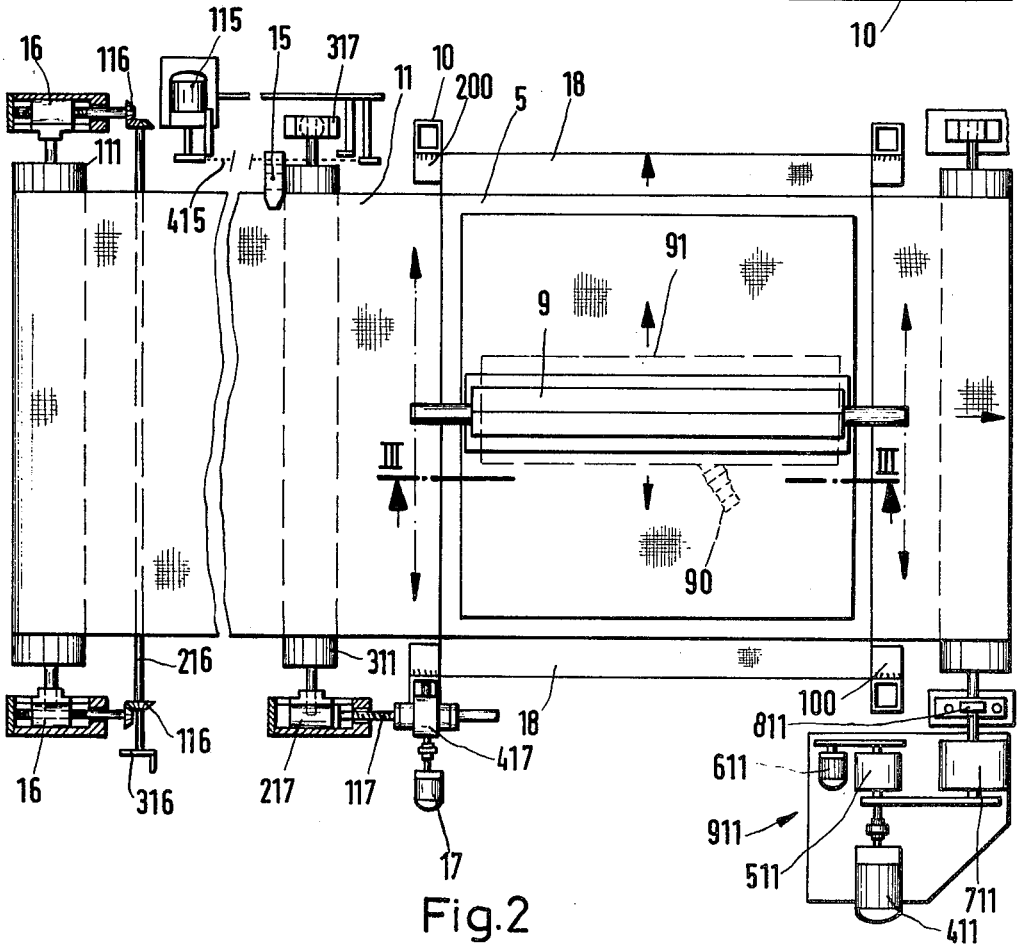
Fig.2

SCREEN PRINTING MACHINE

BACKGROUND OF THE INVENTION

1. Field of the Invention

The present invention relates to a screen printing machine.

More particularly, the invention relates to a screen printing machine for printing on sheet-material workpieces which are supported on a carrier that advances in an endless path.

2. The Prior Art

Screen printing machines of the type here in question are already known. They may utilize an annular printing screen, i.e. a printing screen which itself is endless, or they may even use a different kind of printing screen, for example a stencil-type screen. The sheet material workpiece to be printed, which may be in form of endless or near-endless webs or in form of individual sheets, is usually supported on a printing blanket of rubber or an analogous material. These printing blankets are endless and are guided around reversing rollers located at the front end and at the rear or outlet end of the machine. During its travel in the return run, i.e. as the printing blanket returns from the rear end to the front end of the machine, it must be cleaned so as to remove from it any contaminants, e.g. printing medium or the like which might adhere to the printing blanket so that when it reaches the workpiece supporting run again it is clean and ready to receive the workpiece.

The problem is that these known printing blankets are not gas permeable but that there are many applications in which it is desired to apply suction in order to draw printing medium—e.g. printing ink or printing paste, adhesive, a textile treating material or any other material that can be printed with a screen printing machine onto the workpiece—into the workpiece structure. When this type of operation is required it is therefore the practice in the industry to work without a printing blanket, as is for example disclosed in German allowed application DT-AS No. 1,252,167. In this prior-art machine the workpiece to be printed is engaged at lateral sides of the machine by chains which pull it through the machine over air-permeable plates located at the printing station or stations. This has the advantage that any air-permeable workpiece can be printed according to the suction principle, i.e. suction is applied through the workpiece to draw printing medium into the same. However, there are certain circumstances in which this approach is not satisfactory, for example if the workpieces are heavy ones (e.g. carpets, rugs or the like) which tend to pull out of shape due to their own weight so that, espcially when a pattern is to be printed on the workpiece at successive stations with each pattern to be printed in registry with the preceding pattern, difficulties may occur with respect to obtaining the desired registry. The attempts which have been made in the prior art to avoid this are not always satisfactory, particularly if a high-quality print result is to be obtained.

SUMMARY OF THE INVENTION

Accordingly, it is an object of the present invention to avoid the prior-art disadvantages.

More particularly, it is an object of the present invention to provide an improved screen printing machine which can operate according to the suction principle but is provided with a carrier band on which the workpiece to be printed is supported during its entire travel through the machine.

Another object of the invention is to provide such a screen printing machine wherein pattern registry is reliably assured.

Still a further object of the invention is to provide such a screen printing machine in which pulling out-of-shape of the workpiece is precluded.

In keeping with these objects, and with others which will become apparent hereafter, one feature of the invention resides in a screen printing machine which, briefly stated, may comprise a printing station including a printing screen, means for supporting and transporting a sheet-material workpiece to be printed, including an endless gas-permeable carrier band having a workpiece supporting run extending beneath said printing screen, and suction means below the supporting run for drawing printing ink into the workpiece on the supporting run.

The carrier band may be advanced either continuously or intermittently (stepwise) and of course more than one printing station may be provided. If more than one printing station is provided, then the printing stations will be arranged in sequence, one behind the other, and the carrier band will sequentially transport the workpiece to all of them. Since the workpiece is supported on the supporting run of the carrier band it cannot become pulled out of shape, e.g. stretched or the like, so that the registry of successive prints is greatly increased and thus the equality of the final printed product significantly enhanced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a somewhat diagrammatic side view illustrating a screen printing machine according to the invention;

FIG. 2 is a top-plan view of FIG. 1;

Figure 3:
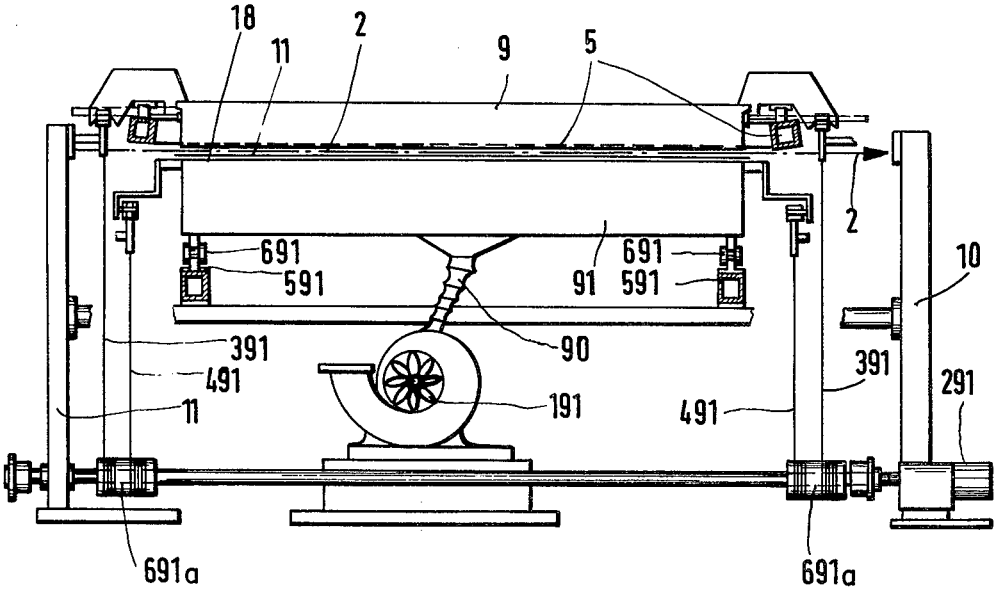
FIG. 3 is an embodiment analogous to although slightly different from the one in FIG. 2, in a section corresponding to the section indicated by line III—III of FIG. 2.

DESCRIPTION OF THE PREFERRED EMBODIMENTS:

Referring now to the drawing, and firstly to FIG. 1, it will be seen that the screen printing machine according to the present invention has a machine frame 10 with which there are associated one or more printing stations each having a printing screen, here illustrated in form of a flat-screen stencil 5. The purpose of the machine is to print on sheet material of any type, such as continuous webs or individual sheets which, if they are to be used in conjunction with the suction device to be discussed subsequently, must of course be permeable to gas. The workpieces of sheet material are identified with reference numeral 2 in all Figures.

Figure 8:
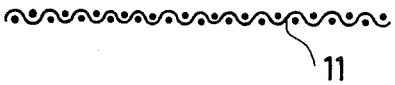
FIG. 8 is a fragmentary section through the carrier band itself.

These workpieces are supported and conveyed through the machine on an endless gas-permeable carrier band 11 which is configurated as a screen band, as most clearly shown in FIG. 8. Of course, other embodiments than the one illustrated in FIG. 8 are possible, for example a flexible belt with a large number of perforations per unit surface area could be employed instead. In any case, the carrier band 11 is trained about reversing rollers 111 and 211 as shown in FIG. 1, located at the inlet end and at the outlet end of the machine, respectively. Also provided is a band adjusting roller 311 which engages the band in the return run of the same. Reference numeral 911 identifies a drive for the screen band 11 to advance the same in an endless path in clockwise direction; this drive may serve to either advance the band 11 continuously or discontinuously (stepwise). This may depend upon the type of printing screen, i.e. the drive would normally operate stepwise if a flat-screen stencil 5 is used but could operate continuously if a tubular printing screen or a generally annular printing screen were employed which are known from the art.

Particularly if a plurality of printing stations is provided each using a flat-screen stencil 5, then it is necessary to assure an exact registry of the print at each station with the print produced by the preceding station or stations, and to control the discontinuously operating drive 11 for this purpose. This is effected according to the present invention by measuring means including a measuring device (tongs) which can open and close electrically and straddles one edge portion of the carrier band 11. A separate motor 115 and chain 415 are provided for the device 15 to advance the same. Arranged in the path of movement of the device 15 are switches 215 and 315, and the path of movement of the device 15 is advantageously (but not necessarily) arranged ahead of the printing stations as considered in the direction of movement of the carrier band 11. In the embodiment shown in FIG. 1 the device 15 is electrically connected with the drive 911 for the band 11, via the switches 215 and 315. In this embodiment the drive 911 has a main motor 411, a creep-drive motor 611 and a compensating transmission 511. There is also provided a transmission 711 and a coupling 811. It should be noted here that the structural details of the device 15 are known per se in other arts, although not in this particular art.

In operation the device 15 closes about an edge portion of the carrier band 11 before the same is advanced (this refers to intermittent advancement) so that the device 15 is taken along as the band 11 advances and thus measures exactly the distance through which the band 11 advances. When the device 15 passes the switch 215 which is preset for a specific length of carrier band advancement, it trips the switch 215 which shuts off the motor 411 so that only the motor 611 and the compensating transmission 511 continue to operate, thus slowing down the further advancement of the carrier band 11 to a creeping speed. At this slow speed the carrier band 11 continues to advance until the device 15 reaches the second switch 315 which is located downstream of the switch 215 and trips it. The switch 315, when tripped, shuts off the motor 611 or else it disengages the coupling 811, so that the carrier band 11 now stops. The motor 115 then operates and returns the device 15 via the chain 415 to its starting position as shown in FIG. 1.

The reversing roller 111 for the carrier band 11 may be constructed as a tensioning roller as indicated in FIG. 1, being provided for this purpose with a tensioning device 16. For example it may be journalled at both axial ends in bearings which are movable lengthwise of the direction of advancement of the carrier band 11, and bevel gear drives 116 connected by a common shaft 216 and adjustable by a handwheel 316 (FIG. 2) may be provided to advance the journals and thereby the roller 111 towards the left or the right (in FIGS. 1 or 2) so as to tension the carrier band 11 to the requisite extent.

The roller 311 is provided at one axial end with a pivot bearing 317 which is pivotable about an upright pivot axis, i.e. a pivot axis which extends normal to the direction of advancement of the supporting run of the carrier band 11. At the other axial end the roller 311 is connected with a control motor 17 which acts upon a drive 417 having a screw spindle 117. The screw spindle 117 in turn acts upon a journal 217 for the roller 311, which journal is movable lengthwise of the direction of advancement of the upper run of the carrier band 11 so that the roller 311 can be pivoted about the pivot axis of the pivot bearing 317. This is done in order to assure that the carrier band 11 moves in a straight line over the rollers 111, 211, i.e. that it does not shift axially on these rollers or, if it does shift, to restore it to its original position. A feeler 517 is shown in FIG. 1 and is electrically connected with the control motor 17 to sense the position of one edge of the carrier band 11 and to control the movement of the journal 217 so as to restore the carrier band 11 to its predetermined axial position on the rollers 111, 211 whenever a deviation from this position occurs.

Figure 4:
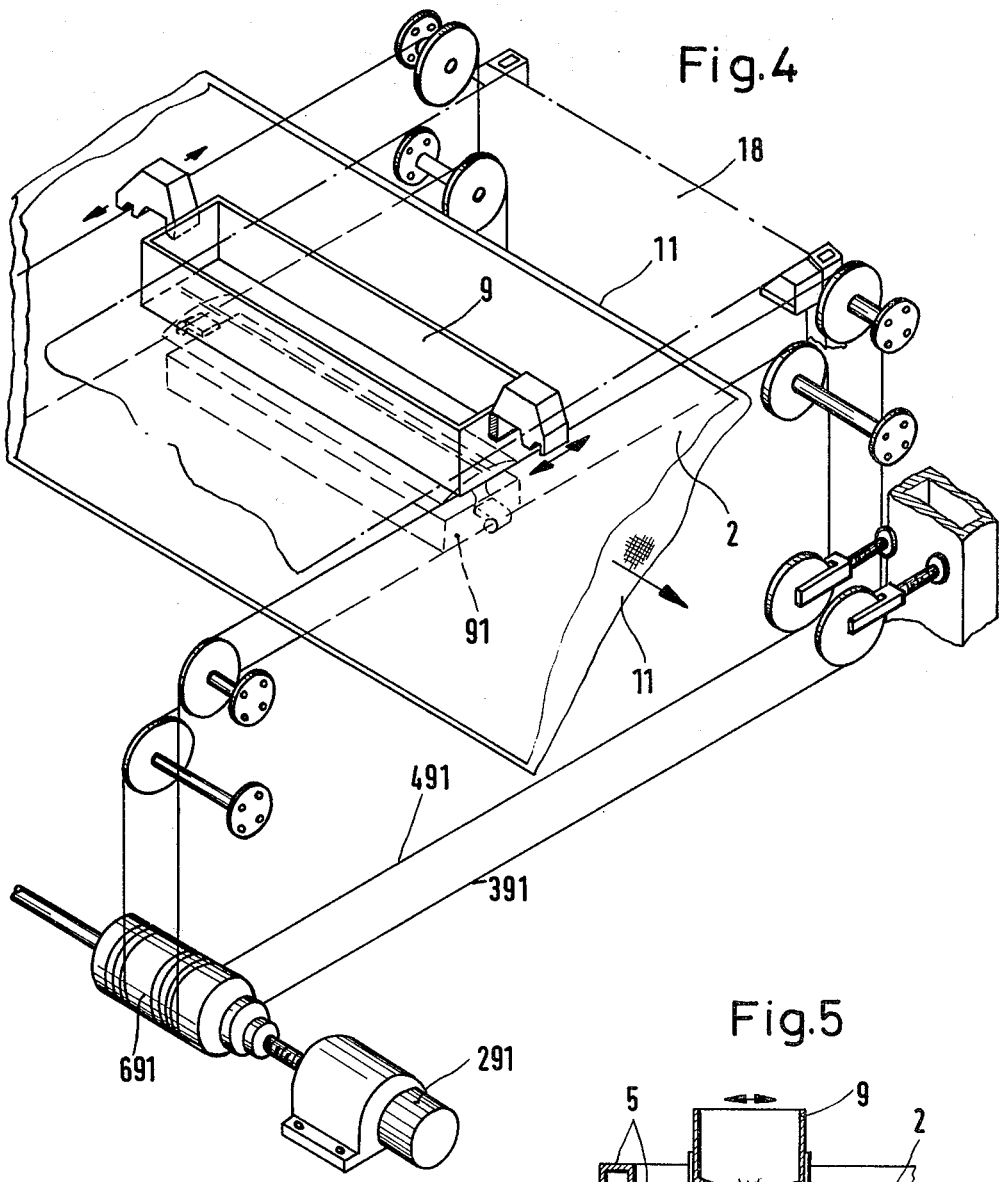
FIG. 4 is a perspective view, partly section, of the embodiment in FIG. 3.

Also shown in FIG. 2 is a squeegee arrangement 9 which moves to-and-fro with reference to the workpiece supporting run of the carrier band 11. The structural details and drive of this arrangement are shown in FIGS. 3 and 4. A suction box 91 is located beneath the squeegee box of this arrangement, and beneath the supporting run of the carrier band 11; it is connected in suitable manner (e.g. via a flexible hose 90) with a suction pump 191. A motor 291 moves the suction box 91 and the squeegee box of the arrangement 9 to-and-fro via rope drives 391 and 491. In FIG. 4 the printing screen has been omitted for clarity, and in this Figure as well as in FIG. 3 the relationship of the components relative to one another is clearly visible. Also shown in FIG. 3 are the rails 591 which extend transversely to the direction of advancement of the carrier band 11 and on which the suction box 91 is supported with rollers 691. Reference numeral **691*a* identifies drums onto which the ropes of the of the rope drives 391 and 491** can be taken up or from which they can be paid out.

Figure 5:
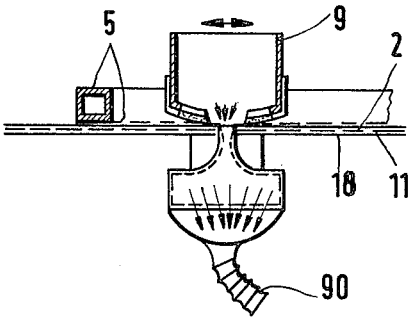
FIG. 5 is a diagrammatic sectioned view, illustrating the operation of the suction applying device disclosed herein.
Figure 6:
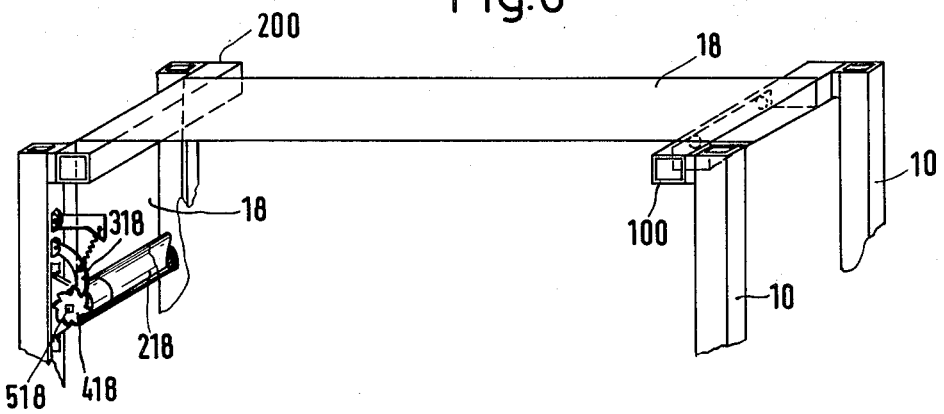
FIG. 6 is a partly sectioned fragmentary perspective view, showing a protective belt which can be used in conjunction with the carrier band in the embodiments of the invention disclosed herein.

FIG. 5 shows how suction applied to the box 91 through the hose 90 or in any other way acts through the supporting run of the carrier band 11 upon the outlet of the squeegee box of the arrangement 9 to draw printing medium (e.g. ink or any other medium which is to be applied to the workpiece 2) into the workpiece so that it will not only be applied to the upper surface of the workpiece but will also be drawn into the workpiece structure. The squeegee itself may be permeable to the suction.

To protect the workpiece supporting run of the carrier band 11 against damage by the constant contact with the suction box 91, and in order to furnish additional support to the supporting run of the carrier band 11, e.g. to reinforce it, a supporting belt 18 (which must of course be also gas permeable) may be located between the workpiece supporting run of the band 11 and the suction box 91. The belt 18 may have one end connected to a transverse beam or support 100 of the frame 10 and its other end placed around a further beam or supporting member 200 of the frame 10 and connected to a takeup roller 218 of a tensioning arrangement 118. The takeup roller is tensioned stepwise by means of a pawl 318 and ratchet wheel 418 so that the belt 18 can always be maintained in taut condition. The device 118 can be operated by inserting, e.g. a polygonal member into a matingly configurated hole 518 to turn the wheel 418 and the roller 218 stepwise as permitted by the pawl 318. FIG. 2 shows that the belt 18 is located beneath the workpiece supporting run of the carrier band 11. Means may be provided for displacing the belt 18 transversely of the path of movement of the band 11.

Figure 7:
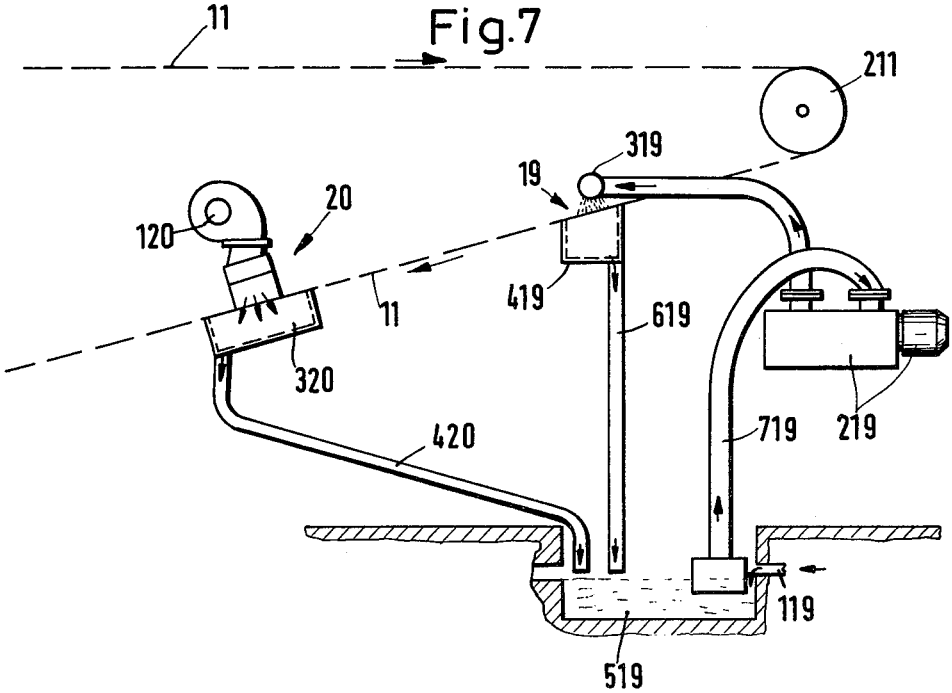
FIG. 7 is a diagrammatic simplified, partly sectioned view illustrating a washing arrangement for washing the carrier band.

As has been mentioned before, it is desirable to clean the carrier band 11 as it returns in the return run from the roller 211 to the roller 111. For this purpose there may be provided adjacent the outlet end of the machine (as shown in FIG. 7) a washing device 19 having a washing liquid reservoir 519 with an inlet 119 for fresh water or other cleaning liquid. A pump 219 pumps the cleaning liquid into a tube 319 which extends transversely of the carrier band 11 above the return run of the same (the connection to the tube 319 is to one axial end of the same which extends laterally beyond an edge portion of the carrier band 11) so that water or other cleaning liquid is sprayed onto the upwardly directed surface of the return run of the band 11 to run through the same into a collecting box 419 arranged below the lower surface of the return run, from where the liquid can be recirculated via the conduit 619 into the reservoir 519.

To remove moisture from the band 11 before it reaches the roller 211 there is provided downstream of the washing arrangement 19 a drying arrangement 20 having a fan 120 at the upper side of the return run and a collecting box 320 at the lower side of the return run. The fan, which may be electrically driven and may be provided with a heater to heat air which it blows onto the return run of the band 11, drives residual moisture into the box 320 from where it is recirculated to the reservoir 519. The suction inlet of the pump 219 is identified with reference numeral 719.

It will be appreciated that various modifications may be made in the disclosed embodiments without departing from the scope and spirit of the invention as set forth in the appended claims.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A screen printing machine, comprising a printing station including a printing screen; means for supporting and transporting a sheet-material workpiece to be printed, including an endless gas-permeable carrier band having a workpiece supporting run extending beneath said printing screen; suction means below said supporting run for drawing printing ink into the workpiece on said supporting run, including a suction device and means for moving said suction device to and fro below said printing run; and means between said supporting run and said suction device for reinforcing said carrier band and protecting the same against damage resulting from relative movement of said carrier band and suction device, the last-mentioned means comprising a gas-permeable belt and adjustable tensioning means for maintaining said belt in taut condition.

2. A machine as defined in claim 1, said carrier band being a screen belt.

3. A machine as defined in claim 1; and further comprising means for continuously advancing said carrier band in an endless path.

4. A machine as defined in claim 1; and further comprising means for intermittently advancing said carrier band stepwise in an endless path.

5. A machine as defined in claim 1; further comprising a drive for advancing said carrier band in an endless path; means for measuring the accuracy of print registry; and means electrically connecting said measuring means with said drive so that the latter is controlled in dependence upon the measurements of the former.

6. A machine as defined in claim 5, said measuring means including a measuring device which is movable to-and-fro with reference to said supporting run in a measuring path, drive means for advancing said measuring device in said path from one to another end position, a pair of adjustable limit switches each adjacent one of said end positions for stopping said drive means when said measuring device reaches the respective end position, and means for adjustably displacing each of said limit switches lengthwise of said path towards the respectively other limit switch to vary the length of said path.

7. A machine as defined in claim 6, said measuring means further including a control switch located ahead of one of said limit switches along said measuring path and engageable by said device, said drive for said carrier band including a creep-drive motor in circuit with said control switch and energized in response to engagement of the control switch by said device.

8. A machine as defined in claim 1, said supporting and transporting means comprising a roller about which said carrier band is trained, and means mounting said roller in the region of one end thereof for pivoting movement about a pivot axis extending normal to said endless path.

9. A machine as defined in claim 8, said mounting means including a pivot bearing; and further comprising a control motor coupled with said roller in the region of the other end thereof, and a sensor in circuit with said control motor and operative to sense the position of an edge of said carrier band on said roller and to signal deviations of said edge from a predetermined position to said control motor to operate the control motor.

10. A machine as defined in claim 1; further comprising means for displacing said gas-permeable belt transversely of said endless path.

11. A machine as defined in claim 10; said tensioning means being operative for tensioning said belt in the longitudinal direction thereof.

12. A machine as defined in claim 11, said tensioning means comprising a takeup roller for said belt, and a ratchet-and-pawl drive connected with said takeup roller to turn the take-up as required for tensioning said belt.

13. A machine as defined in claim 1; and further comprising washing means for passing a washing liquid through said carrier band to remove contaminants adhering to the carrier band.

14. A machine as defined in claim 13; and further comprising drying means downstream of said washing means for passing a stream of drying gas through said carrier band to remove moisture from the carrier band.

15. A machine as defined in claim 1, said printing station further comprising a suction-permeable squeegee.

16. A machine as defined in claim 1; further comprising a drive for advancing said carrier band in an endless path; means including a measuring device for measuring the accuracy of print registry; means electrically connecting said measuring device with said drive so that the latter is controlled in dependence upon the measurements of said device and for effecting movement of said device relative to said supporting run, including a limit switch and a control switch upstream of said limit switch as considered in the direction of movement of said device and both electrically connected to said drive for said carrier band, and a chain drive for restoring said device from one to the other of its end positions.

* * * * *